US005097822A

United States Patent [19]

Francis et al.

[11] Patent Number: 5,097,822

[45] Date of Patent: Mar. 24, 1992

[54] VIBRATING BELT MASSAGER

[75] Inventors: Paul S. Francis, Kansas City, Mo.; Todd L. Doyle, Kansas City, Kans.; Teryl K. Rouse, Kansas City, Mo.

[73] Assignee: Triad Products, Inc., Kansas City, Mo.

[21] Appl. No.: 529,123

[22] Filed: May 25, 1990

[51] Int. Cl.[5] ..... A61H 7/00

[52] U.S. Cl. ..... 128/52; 128/24.1; 128/44; 128/62 R; 128/63

[58] Field of Search ..... 128/24.1, 24.2, 32, 128/44, 42, 48, 49, 62 R, 63; 15/22 R, 22 B, 222, 97.1, 97.2

[56] References Cited

U.S. PATENT DOCUMENTS 2,026,527 1/1936 Gonsett ..... 128/63
3,099,032 7/1963 Webb ..... 128/63
3,124,822 3/1964 Marchese ..... 128/63
3,720,205 3/1973 Liebman ..... 128/63 X
3,959,841 6/1976 Horne ..... 128/63 X

*Primary Examiner*—Robert A. Hafer
*Assistant Examiner*—Brian E. Hanlon
*Attorney, Agent, or Firm*—Kokjer, Kircher, Bowman & Johnson

[57] ABSTRACT

A hand held reciprocating belt massager driven by an electric motor to massage sore muscles. The opposite ends of the belt are equipped with handles, one of which houses the motor and a drive train that reciprocates the belt longitudinally when the motor is in operation. The other hand grip connects flexibly with the belt through a resilient elastomer bar that accommodates the belt reciprocation. A detachable thermal pack is applicable to the belt to provide heating in conjunction with the massaging action of the belt.

18 Claims, 2 Drawing Sheets

VIBRATING BELT MASSAGER

BACKGROUND AND SUMMARY OF THE INVENTION

This invention relates generally to the treatment of muscle problems and more particularly to a massaging device having a motor driven reciprocating belt that is applicable to the body to alleviate muscle related discomfort.

It has long been known that muscle tightness and soreness can be alleviated by heating and/or massaging the afflicted area to relax and soothe the muscles and improve the circulation. Various types of massaging devices have been proposed in the past, including hand-held pads and wands which are vibrated by an electric motor, cushion and seat vibrators, foot massagers, whirlpool and other hydrotherapy devices, and heating wraps. Of these, only the pad and wand devices are hand-held units that are readily portable.

Many muscle problems occur in the back and neck areas, and these areas are difficult to reach in order to effectively massage the afflicted muscle. Known hand-held massager which employs a belt is equipped with an electric motor which is mounted near the center of the belt and which rotates an eccentric weight that creates the massaging action. However, because the vibration that is imparted to the belt extends only to the part of the belt in the immediate vicinity of the motor, the massaging action is not only weak but is also highly localized. Consequently, muscles which are displaced from the motor location are not treated effectively, and larger muscles likewise fail to receive complete treatment.

The present invention is directed to a hand-held belt type massaging device in which the entire length of the belt is reciprocated longitudinally so that the belt vibration covers the entire area of the body to which the belt is applied. This is accomplished by providing an electric motor in one hand grip and a resilient connection between the strap or belt and the opposite hand grip. The motor is connected with the belt through a yoke linkage which causes the belt to reciprocate, and the flexible or resilient connection of the other hand grip accommodates the reciprocation of the belt. As a consequence, the entire belt is vibrated back and forth so that it is able to message the entire area of the body which is contacted by the belt. Large muscles and muscle groups are thus effectively treated by the belt.

The invention is further characterized by swivel connections between the belt and hand grips in order to facilitate application of the belt to the back, neck and other hard to reach places. The hand grips are also specially constructed in a manner allowing them to be conveniently yet securely gripped in the hands while making the controls readily accessible in order to turn the device on and off and vary the speed of vibration. In the latter respect, it is a feature of the invention that a multiple speed motor is preferably used so that the speed at which the belt is reciprocated can be adjusted depending upon the preference of the user.

Another feature of the invention is the provision of a gel type heating pack which may be applied to the belt. The heating pack is preferably detachable, and when it is in use, it applies therapeutic heat to the afflicted area along with the massaging effect that is provided by the belt. In many cases, the combined heat and massaging action is particularly effective in alleviating discomfort caused by tight or sore muscles.

Rechargeable batteries may be mounted in one of the handles in order to supply electric power for operating the motor. Alternatively, the device may be equipped with a conventional plug in power cord that may be plugged into a conventional wall outlet to provide AC power for operating the motor. In either case, the device is constructed in a simple and economical manner, is lightweight and easily stored and transported, is simple to use, and is aesthetically appealing.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figures 1, 2, 6:
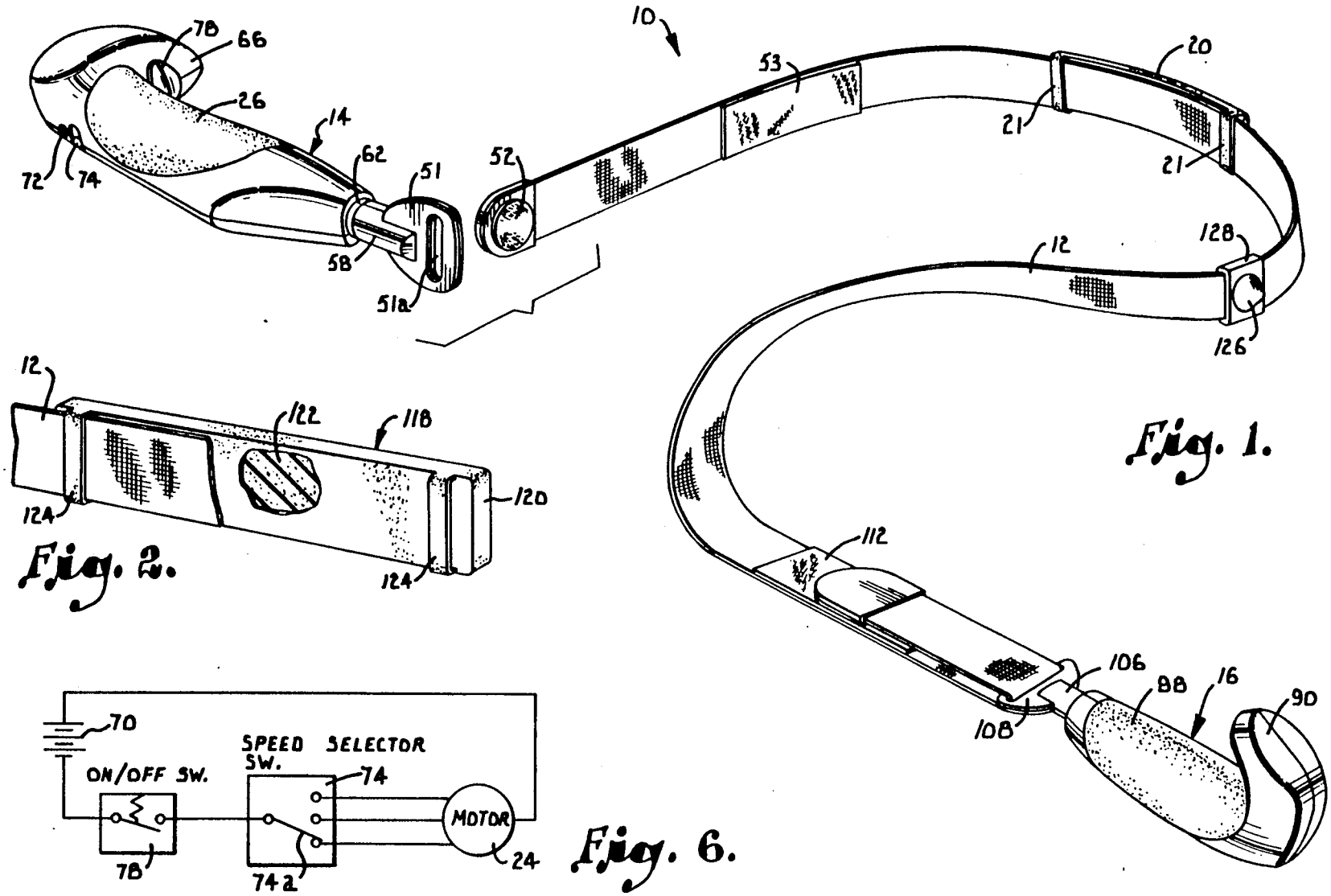
FIG. 1 is an exploded perspective view of a belt type massaging device constructed according to a preferred embodiment of the present invention, with the break lines in the belt indicating continuous length.
FIG. 2 is a fragmentary elevational view of one end portion of the massaging device, with the hand grip shown in section for purposes of illustration and the broken lines illustrating the manner in which the belt is reciprocated longitudinally by the electric motor mounted in the hand grip.
FIG. 6 is a diagrammatic view of the electrical circuitry of the massage device.

Referring now to the drawings in more detail, numeral 10 generally designates a belt massaging device constructed in accordance with a preferred embodiment of the present invention. The massaging device 10 includes a reciprocating strap or belt 12 which is equipped on its opposite ends with handles 14 and 16. The belt 12 is flexible and is constructed of a flexible fabric strap 18 and a foam strip 20 which is suitably laminated to one face of the strap 18 by adhesive or some other means. The outer face of the foam strip 20 is textured by a plurality of space apart nibs 22 which project from the surface of the strip 20. The nibs 20 enhance the massaging action of the belt when it is applied to the human body.

Figure 4:
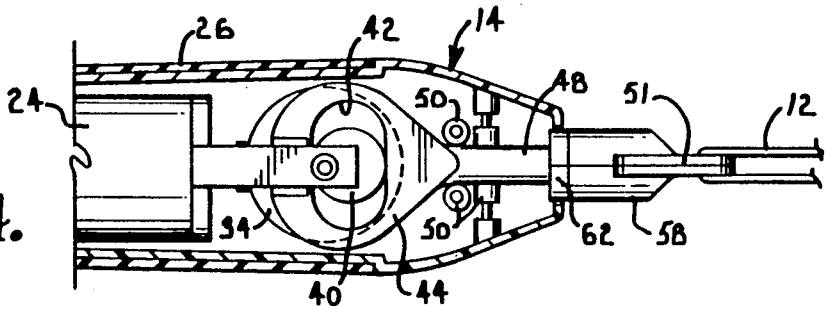
FIG. 4 is a fragmentary sectional view taken generally along line 4—4 of FIG. 2 in the direction of the arrows.

The belt 12 is reciprocated longitudinally by an electric motor 24 (see FIG. 2) which is mounted within a cylindrical hand grip 26 forming part of handle 14. The handle 14 is hollow and the exterior surface of the hand grip 26 is a high friction surface which provides a secure grip when grasped by the hand of a user. The motor 24 is preferably a three speed electric motor which is retained in place by mounting pads 28 that extend internally of the hand grip 26. When energized, the motor 24 rotates an output shaft 30 which carries a bevel gear 32 on its end. As best shown in FIG. 4, gear 32 mates with and drives a larger bevel gear 34 mounted on a shaft 36 which extends perpendicular to the output shaft 30 of the motor 24. The shaft 36 is supported for rotation by bushings 38 which project internally of the hand grip 26.

The rotational motion of the motor output shaft 30 is converted into reciprocating longitudinal vibration of the belt 12 by the bevel gearing and by a yoke mechanism driven by a wheel 40 which is carried on the shaft 36. The wheel 40 is mounted eccentrically or off center on the shaft 36, as best shown in FIG. 2. The wheel 40 operates in an oval opening 42 which is formed in one end of a yoke 44. The yoke 44 is provided with a projecting lug 46 (see FIG. 4) from which a pin 48 extends. The pin 48 is axially aligned with the motor output shaft 30 and extends through a bushing 50 which is fitted on the end of the hand grip 26. The bushing 50 supports pin 48 for axial reciprocation which results from operation of the motor 24.

The end portion of the fabric strap 18 adjacent to handle 14 is threaded through a slot in a bracket 52 and is secured by a buckle 53 which provides adjustment for the length of the strap 18. The handle 14 has a swivel connection with the bracket 52. The end of pin 48 is provided with a circular head 54 which fits in a complemental recess 56 formed in the base 58 of the bracket 52. The head 54 is able to rotate in the recess 56 in order to mount the handle 14 for swiveling or rotational movement about the axis of pin 48, thus allowing the handle 14 to swivel on the end of the belt 12. In addition, the swivel connection established by the fit of the head 54 in the recess 56 causes the belt 12 to reciprocate longitudinally in response to axial reciprocation of the pin 48.

The bushing 50 and the swivel connection are covered by an expansible and collapsible bellows 60. One end of the bellows is secured to a flange 62 on the bushing 50, while the opposite end of the bellows is secured to another flange 64 formed on the base 58 of bracket 52. The bellows 60 has a pleated accordion construction which allows it to expand and collapse longitudinally in order to accommodate longitudinal reciprocation of the pin 48 and the belt 52. At the same time, the bellows 60 provides a cover for the bushing 50, pin 48 and the base 58.

Handle 14 has a generally U-shaped configuration and includes a leg 66 which is generally parallel to the hand grip 26 and which is connected with the hand grip by a bight portion 68 of the handle. The handle 24 is hollow and houses a plurality of rechargeable batteries 70 which may be carried in the leg 66 and the bight portion 68 of the handle. The batteries 70 are connected with the motor 24 by suitable wiring and may be recharged by plugging a conventional battery charger circuit into a socket 72 which is provided on the handle 14 and which is suitably connected with the batteries.

The motor 24 is preferably a three-speed motor, the speed of which is controlled by a speed setting switch 74 having three different settings corresponding with the low, medium and high speeds of the motor. The switch 74 is mounted within the handle 14 and preferably has a switch actuator which projects from the bottom of the hand grip 26 near its outer end (see FIG. 2).

Energization and deenergization of the motor 24 is controlled by a momentary on/off switch 76. The switch 76 is mounted within the bight portion 68 of handle 14 and has a projecting switch actuator 78 which is normally biased toward an extended position in which the switch 76 is in an open condition. The actuator 78 may be depressed in order to close the switch 76, thus energizing the motor 24. The actuator 78 is controlled by pivoting trigger 80 which is located at a conveniently accessible position. In particular, the trigger 80 projects from the bight portion 68 of handle 14 at location between the leg 66 and the hand grip 26 such that it can be pivoted inwardly by a hand applied to the hand grip 26, thereby depressing the switch actuator 78 to energize the motor 24 and the reciprocating belt 12.

Figure 3:
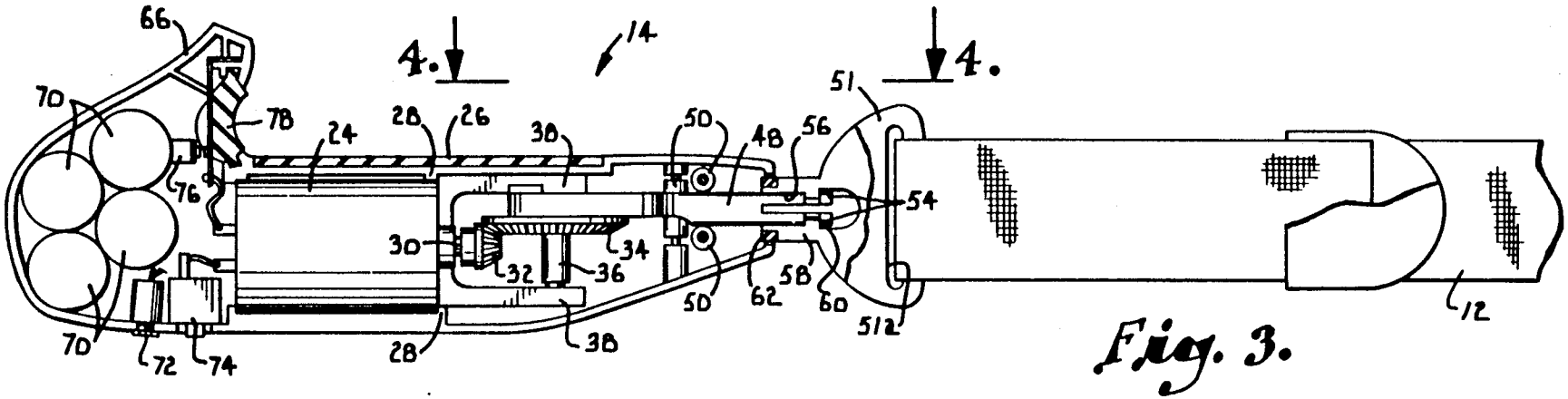
FIG. 3 is an elevational view of the end of the belt opposite the end shown in FIG. 2, with the hand grip shown in section for purposes of illustration.

The other handle 16 has a U-shaped or hooked configuration substantially the same as handle 14. However, the internal construction of handle 16 differs from that of handle 14. As best shown in FIG. 3, a hollow tubular shell 82 is secured in a curved passage 84 which is formed internally of the handle 16. Handle 16 is provided with a hand grip 88 and with a leg 90 which extends generally parallel to the hand grip 88 and is connected with the hand grip by a curved bight portion 92 of the handle 16. Extending within the hollow interior of the shell 82 is a flexible, resilient bar 94 which is preferably constructed of an elastomer which can be stretched longitudinally and which resists stretching and naturally applies a force tending to restore the elastomer to its undeformed condition. The shell 82 is securely crimped at 96 to one end of the bar 94 in order to rigidly secure that end of the bar in place at the free end portion of the leg 90. The opposite end of the bar 94 projects out of shell 82 and is fitted around and secured to a barbed base end 98 of a short stud 100.

The stud 100 provides a swivel connection between handle 16 and the belt 12. A circular head 102 on one end of stud 100 fits in a complemental recess 104 formed in the base 106 of a bracket 108. The adjacent end of the fabric strap 18 is in turn threaded through a slot in the bracket 108 and secured by a buckle 110. The head 102 is able to rotate in recess 104 about the axis of the stud 100, thus mounting handle 16 such that it can swivel on the end of the reciprocating belt 12. At the same time, the resilient connection provided by the bar 24 allows the belt 12 to reciprocate longitudinally relative to the handle 16.

The swivel connection for the handle 16 is covered by an expansible and collapsible bellows 112 which is constructed in the same manner as the other bellows 60. One end of bellows 112 is secured to a flange 114 on the base 106, and the other end of the bellows is secured to a flange 116 on the end of the tubular shell 82. Again, the ability of the bellows 112 to expand and contract longitudinally accommodates lengthwise reciprocation of the belt 12 relative to the handle 16.

Figure 5:
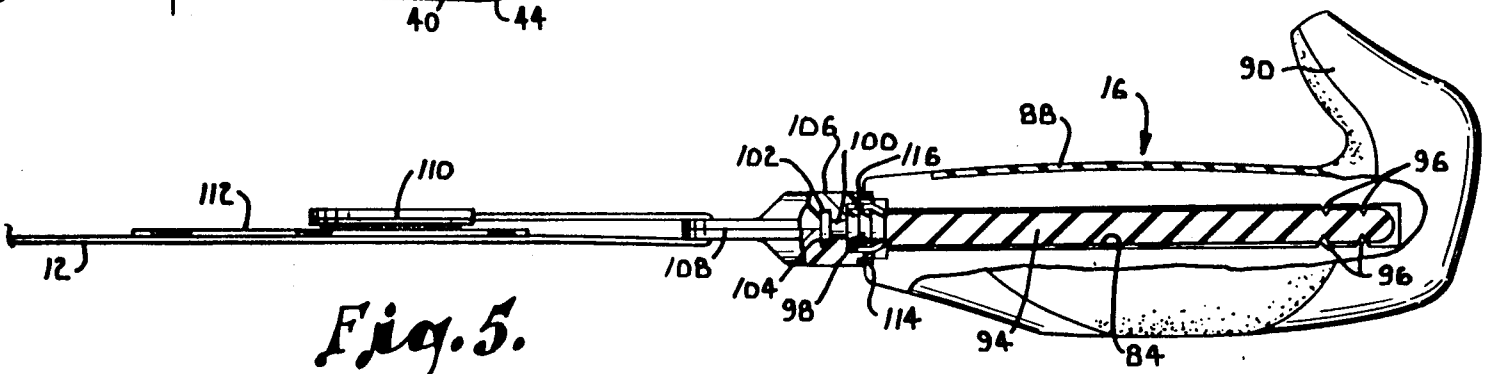
FIG. 5 is a fragmentary sectional view taken generally along line 5—5 of FIG. 3 in the direction of the arrows, with a portion of the heating pack envelope broken away for purposes of illustration.

The massaging device 10 is additionally provided with a heat pack which is generally identified by numeral 118 (see FIGS. 1 and 5 in particular) and which includes an enclosed envelope 120 which is filled with a suitable heating gel 122 (FIG. 5). The heating gel 122 is of the type that can be heated in a microwave oven or the like and which thereafter emits heat for some period of time. A pair of flexible flaps 124 and 126 extend from the envelope 120 and may be wrapped around the belt 12 in the manner shown in FIG. 5. The edges of the flaps which overlap are equipped with mating fasteners 128 which may be snap fasteners that serve to releasably secure the heating pack 118 in place on the belt 12. The snaps 128 may easily be detached in order to permit the heating pack 118 to be removed from the belt 12.

FIG. 6 is a diagrammatic view of the electrical circuitry of the device 10. The battery 70 supplies electrical power through the two switches 76 and 74 to the motor 24. When the switch 76 is closed, the circuit is completed through the motor, and the speed at which the output shaft 30 is rotated depends upon the position of the switch element 74*a* of the speed selector switch 74.

In use, the massaging device 10 serves t o apply massaging action to sore muscles and particularly the muscles of the back and neck. However, the device may be applied to other areas as well, including the legs, arms and other areas of the human body.

In order to apply the device 10 to the afflicted muscles, the belt 12 is drawn in a taut condition behind the back or neck and applied to the area that is to be treated. The hand grips 26 and 88 are gripped in the hands of the user with the webbed areas of the hand between the thumbs and index fingers located adjacent to the bight portions 68 and 92. The user can apply the web area of one hand to the trigger 80 in order to pivot it inwardly to depress the switch actuator 78, thus energizing the motor 24. The hook configurations of the handles 14 and 16 permits the user to securely grip the handles without the handles slipping out of the hands.

The rotation of shaft 30 is transferred through the bevel gears 32 and 34 into rotation of shaft 36, thus rotating the wheel 40 eccentrically. Because of the fit of the wheel 40 in the oval opening 42 of yoke 44, eccentric rotation of the wheel is translated into axial reciprocation of the yoke and its pin 48. This in turn causes the belt 12 to be driven in reciprocating longitudinal vibrational motion, and it is noteworthy that the entire belt 12 is longitudinally reciprocated. It is also noteworthy that the flexible connection provided by the resilient bar 94 allows the belt 12 to reciprocate relative to the handle 16 which normally remains stationary during treatment. At on end of the stroke of pin 48, the bar 94 will be stretched, and the bar thus pulls belt 12 back toward handle 16 as the pin 48 is reciprocated toward the other end of its stroke. Consequently, the belt 12 is able to reciprocate back and forth while both handles 14 and 16 remain stationary.

The massaging action that is applied to the muscles by the belt 12 (and particularly the nibbed surface of the foam strip 20) provides a soothing effect that relieves pain due to sore or tense muscles. In addition, the heating pack 118 may be used and applied to the afflicted area at the same time as the massaging action and this can in some cases be particularly effective in relieving muscle discomfort.

As an alternative to battery operation of the motor 24, the motor can be powered by AC household current. In this respect, the handle 14 may be equipped with an electrical cord carrying a conventional plug on its end that can be plugged into an available wall outlet, thus providing electrical power that may be used to drive the motor 24. It is to be understood that the present invention is equally applicable to battery operation and AC power operation.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

We claim:

1. Apparatus for massaging the human body, comprising:
   - an elongate flexible strap having opposite end portions;
   - hand grips on the opposite end portions of said strap;
   - a motor in one of said hand grips, said motor having energized and deenergized conditions;
   - means for coupling said motor with said strap in a manner to effect lengthwise reciprocating movement of the strap relative to the hand grips when the motor is in the energized condition; and
   - switch means for switching the motor between the energized and deenergized conditions.

2. Apparatus as set forth in claim 1, wherein said switch means comprises a switch actuator on said one hand grip.

3. Apparatus as set forth in claim 2, wherein said motor has multiple speeds of operation in the energized condition and including speed switch means on said one hand grip for setting the speed of operation of the motor.

4. Apparatus as set forth in claim 1, wherein said motor has multiple speeds of operation in the energized condition and including speed switch means for setting the speed of operation of the motor.

5. Apparatus as set forth in claim 1, including flexible means in the hand grip opposite said one hand grip for coupling said opposite hand grip with said strap in a manner permitting reciprocating lengthwise movement of the strap relative to said opposite hand grip.

6. Apparatus as set forth in claim 1, including a handle on each end of the strap, each handle presenting the corresponding hand grip thereon.

7. Apparatus as set forth in claim 1, wherein said strap comprises a flexible fabric and a sleeve applicable to said fabric and providing a cushioning effect.

8. Apparatus as set forth in claim 1, including a thermal pack on the strap operable to thermally affect the body when the strap is applied thereto.

9. Apparatus as set forth in claim 8, wherein said thermal pack includes heat emitting gel.

10. Apparatus as set forth in claim 8, including means for releasably attaching said thermal pack to the strap.

11. Apparatus as set forth in claim 1, including means for establishing swivel connections between said hand grips and the respective ends of the strap.

12. Belt massaging apparatus for massaging the human body, comprising:
   - an elongate flexible strap having opposite end portions;
   - a pair of hand grips for the respective opposite end portions of said strap;
   - an electric motor in one of said hand grips, said motor having an output shaft and energized and deenergized conditions wherein the output shaft is rotated and idle, respectively;
   - means for coupling said output shaft with one end portion of said strap in a manner to effect pulling of the strap longitudinally in one direction during one part of each cycle of the motor;

means for resiliently coupling the other end portion of said strap with the other hand grip in a manner to effect pulling of the strap longitudinally in the opposite direction during the remaining part of each cycle of the motor, whereby the strap is reciprocated lengthwise relative to said hand grips during each cycle when the motor is energized; and switch means for switching the motor between the energized and deenergized conditions.

13. Apparatus as set forth in claim 12, wherein said resilient coupling means comprises a resilient element in said other hand grip connected at one end to said other hand grip and at another end to said other end portion of the strap, said resilient element stretching during said one part of each cycle and resisting stretching to pull the strap back during said remaining part of each cycle.

14. Apparatus as set forth in claim 13, including means for establishing a swivel connection between said other end of the resilient element and said other end portion of the strap to mount said other hand grip for swiveling movement on the strap.

15. Apparatus as set forth in claim 12, wherein said output shaft coupling means comprises:

a pin supported in said one hand grip for axial reciprocation, said pin being connected with said one end portion of the strap to effect pulling the strap longitudinally in response to axial movement of said pin in one direction; and means for converting rotation of said output shaft into axial reciprocation of said pin.

16. Apparatus as set forth in claim 15, including means for establishing a swivel connection between said pin and said one end portion of the strap to allow said one hand grip to swivel on the strap.

17. Belt massaging apparatus for hand held application to the human body, said apparatus comprising:

an elongate flexible strap having opposite ends;

a pair of hand grips adapted to be held in the hands;

means for mounting said hand grips on the respective opposite ends of said strap in a manner permitting each hand grip to swivel on the strap; and means for effecting reciprocating vibrational movement of said strap along substantially the entire length thereof.

18. Apparatus as set forth in claim 17, wherein:

said movement effecting means comprises an electric motor in one of said hand grips and a pin supported in said one hand grip for axial reciprocation, said pin being connected with said strap and being axially reciprocated by said motor upon energization thereof to effect longitudinal movement of the strap in one direction during part of each cycle of the motor; and said mounting means comprises a resilient connection between the other hand grip and said strap effective to permit longitudinal movement of the strap relative to said other hand grip in said one direction, said resilient connection acting to move the strap longitudinally in a direction opposite said one direction during the remaining part of each cycle of the motor.

* * * * *